US009930945B2

(12) United States Patent
Mosharrafa

(10) Patent No.: US 9,930,945 B2
(45) Date of Patent: Apr. 3, 2018

(54) SYSTEMS AND METHODS FOR A PROTECTIVE SLEEVE FOR ELECTRONIC DEVICES

(71) Applicant: Nice Touch, L.L.C., Phoenix, AZ (US)

(72) Inventor: Ali M. Mosharrafa, Paradise Valley, AZ (US)

(73) Assignee: Nice Touch, LLC, Phoenix, AZ (US)

( * ) Notice: Subject to any disclaimer, the term of this patent is extended or adjusted under 35 U.S.C. 154(b) by 0 days.

(21) Appl. No.: 15/290,982

(22) Filed: Oct. 11, 2016

(65) Prior Publication Data

US 2017/0099923 A1 Apr. 13, 2017

Related U.S. Application Data

(60) Provisional application No. 62/239,038, filed on Oct. 8, 2015.

(51) Int. Cl.
*A45C 11/00* (2006.01)

(52) U.S. Cl.
CPC ..... *A45C 11/00* (2013.01); *A45C 2011/002* (2013.01)

(58) Field of Classification Search
CPC ..... A45C 2011/002; A45C 11/00
USPC ..... 383/104, 120
See application file for complete search history.

(56) References Cited

U.S. PATENT DOCUMENTS 2,962,158 A * 11/1960 Struthers ..... B65D 75/26 206/523
4,471,872 A * 9/1984 Dedow ..... B65D 81/03 206/720
4,496,406 A * 1/1985 Dedow ..... B65D 81/03 156/290
4,581,874 A * 4/1986 Rechtsteiner ..... B65B 55/027 206/484
4,793,486 A * 12/1988 Konopka ..... A61M 5/1417 206/305
5,163,606 A * 11/1992 Isserstedt ..... A45C 7/0059 229/67.2
5,330,269 A * 7/1994 Kamada ..... B65D 33/2525 383/210
5,620,133 A * 4/1997 Isserstedt ..... A45C 7/0059 229/67.1
5,755,329 A * 5/1998 Sadow ..... A45C 13/021 206/320

(Continued)

*Primary Examiner* — Peter Helvey
(74) *Attorney, Agent, or Firm* — The Noblitt Group, PLLC

(57) ABSTRACT

Methods and systems for a protective sleeve for an electronic device according to various aspects of the present technology may function as a substantially impermeable barrier between moisture and/or air and the electronic device. Various embodiments of the protective sleeve may comprise a front panel coupled to a back panel, forming an internal volume that may be sealed toward a bottom open end by an expandable sheet member and a fastener toward a top open end. The expandable sheet member may fold inwardly towards a mid-portion of the internal volume to form a ridge flanked by two inwardly projecting surfaces. Expansion of the expandable sheet member may reduce a degree of inward projection of the two inwardly projecting surfaces above horizontal and may modify the shape of the internal volume to effect standing the protective sleeve upright on a surface.

24 Claims, 12 Drawing Sheets

(56) References Cited

Figure 1A:
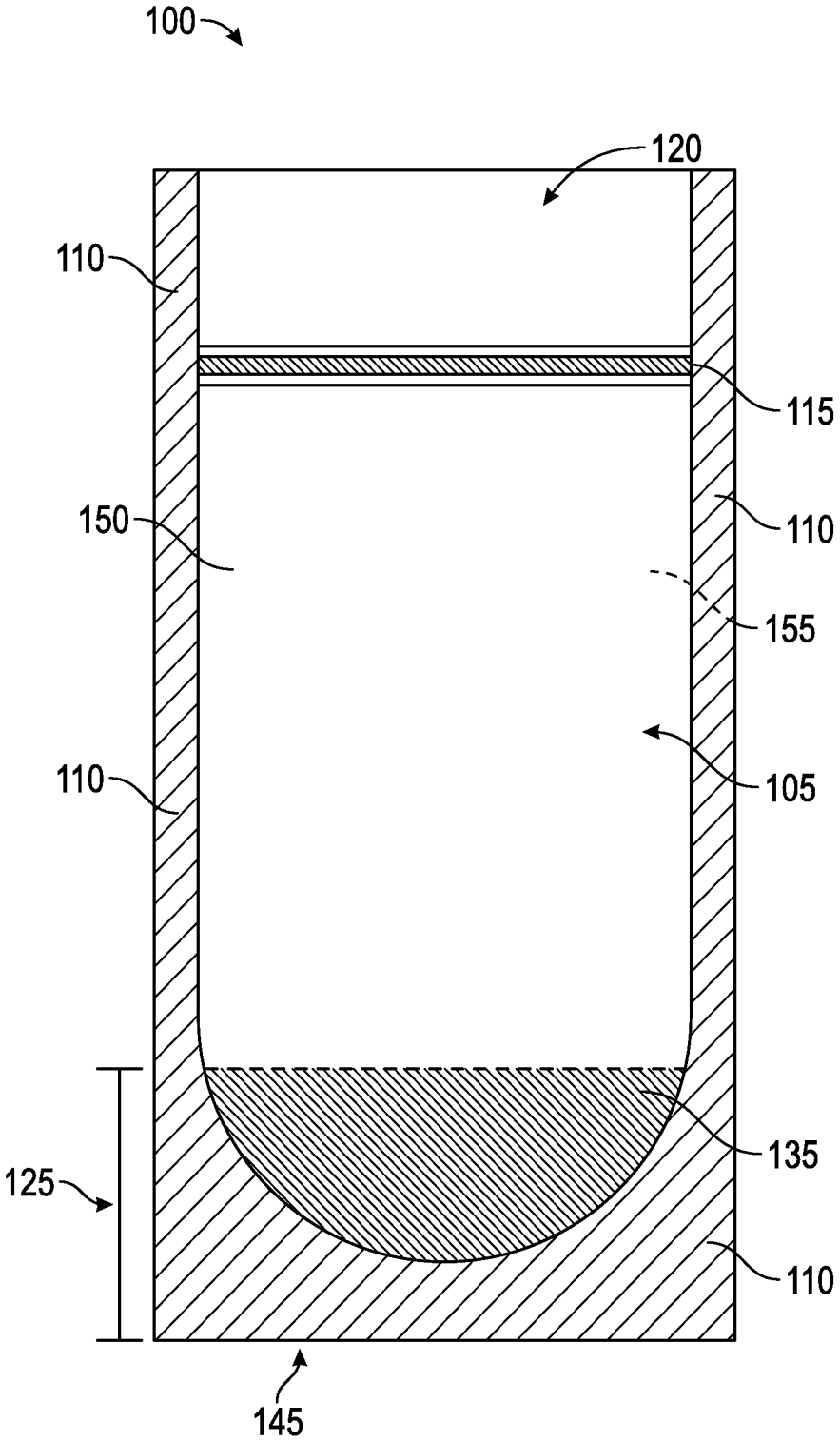

U.S. PATENT DOCUMENTS 5,881,883 A * 3/1999 Siegelman ..... B65D 81/03 206/701
6,289,896 B1 * 9/2001 Hart ..... A61B 46/10 128/897
6,817,470 B1 * 11/2004 Goldberg ..... H01H 9/0242 150/165
7,843,432 B2 * 11/2010 Sween ..... A45C 9/00 206/307.1
8,118,021 B2 * 2/2012 Cho ..... A47J 36/28 126/263.01
8,186,514 B2 * 5/2012 Bowers ..... A45C 7/0095 206/320
8,961,015 B1 * 2/2015 Bihn ..... A45C 3/001 383/105
2003/0213543 A1 * 11/2003 Perrine ..... B29C 65/08 156/73.1
2007/0014491 A1 * 1/2007 MacAuley ..... H05K 5/061 383/59
2007/0047849 A1 * 3/2007 Williams ..... A45C 1/06 383/38
2007/0076987 A1 * 4/2007 Vuicich ..... A45C 11/00 383/105
2007/0131568 A1 * 6/2007 Georgia ..... A45C 13/02 206/223
2007/0215663 A1 * 9/2007 Chongson ..... A45C 1/04 224/650
2007/0217717 A1 * 9/2007 Murray ..... B65B 43/04 383/38
2008/0247682 A1 * 10/2008 Murray ..... B65B 3/02 383/104
2009/0056281 A1 * 3/2009 Murray ..... B65B 3/02 53/455
2009/0148078 A1 * 6/2009 Skyler ..... B65D 31/02 383/42
2009/0314677 A1 * 12/2009 Teggatz ..... A45C 13/08 206/457
2010/0181220 A1 * 7/2010 Dasara ..... A61B 50/31 206/438
2010/0310194 A1 * 12/2010 Archambault ..... A45C 11/22 383/42
2011/0091136 A1 * 4/2011 Danch ..... A45C 1/02 383/59
2012/0008884 A1 * 1/2012 Murray ..... B65B 3/02 383/104
2012/0114270 A1 * 5/2012 Roberts ..... A45C 11/00 383/109
2012/0251756 A1 * 10/2012 Buckley ..... C09J 7/0296 428/41.8
2013/0188890 A1 * 7/2013 Naor ..... B65D 83/08 383/71
2014/0270583 A1 * 9/2014 Anderson ..... B65D 31/04 383/37
2015/0353237 A1 * 12/2015 Haedt ..... B65D 75/5805 383/207

* cited by examiner

SYSTEMS AND METHODS FOR A PROTECTIVE SLEEVE FOR ELECTRONIC DEVICES

CROSS-REFERENCES TO RELATED APPLICATIONS

This application claims priority to U.S. Provisional Patent Application Ser. No. 62/239,038 filed on Oct. 8, 2015, and incorporates the disclosure of this application by reference. To the extent that the present disclosure conflicts with any referenced application, however, the present disclosure is to be given priority.

BACKGROUND

Electronic devices used frequently in areas with a high volume of human traffic tend to harbor high levels of bacteria and promote unsanitary conditions. Humans may transmit the bacteria to the electronic devices through touching with unclean hands, coughing, spilling food and drinks, and the like. The bacteria found on electronic devices may comprise dangerous types of bacteria known to cause human illness such as *Listeria, Pseudomonas, Bacillus, Escherichia coli* and *Salmonella.* Left uncleaned, the bacteria on these devices can be transmitted to other humans. Additionally, bacteria may form tight connections with the surface of the electronic devices to form a biofilm. Biofilms may be resistant to heat, light, dry conditions, and even chemical cleaners.

Electronic devices may not be amenable to sanitization using conventional cleaning methods such as chemical cleaning, submersion in soap and water, and boiling without damaging the electronics within the electronic device. Mere wiping of the surface of the electronic device may not adequately clean the surface and may not reach bacteria that may be harbored in crevices, corners, narrow areas between buttons or other protrusions, and design elements.

SUMMARY

Methods and systems for a protective sleeve for an electronic device according to various aspects of the present technology may function as a substantially impermeable barrier between moisture and/or air and the electronic device. Various embodiments of the protective sleeve may comprise a front panel coupled to a back panel, forming an internal volume that may be sealed toward a bottom open end by an expandable sheet member and a fastener toward a top open end. The expandable sheet member may fold inwardly towards a mid-portion of the internal volume to form a ridge flanked by two inwardly projecting surfaces. Expansion of the expandable sheet member may reduce a degree of inward projection of the two inwardly projecting surfaces above horizontal and may modify the shape of the internal volume to effect standing the protective sleeve upright on a surface.

BRIEF DESCRIPTION OF THE DRAWING FIGURES

A more complete understanding of the present technology may be derived by referring to the detailed description when considered in connection with the following illustrative figures. In the following figures, like reference numbers refer to similar elements and steps throughout the figures.

Elements and steps in the figures are illustrated for simplicity and clarity and have not necessarily been rendered according to any particular sequence or scale. For example, steps that may be performed concurrently or in different order are illustrated in the figures to help to improve understanding of embodiments of the present technology.

Figure 2:
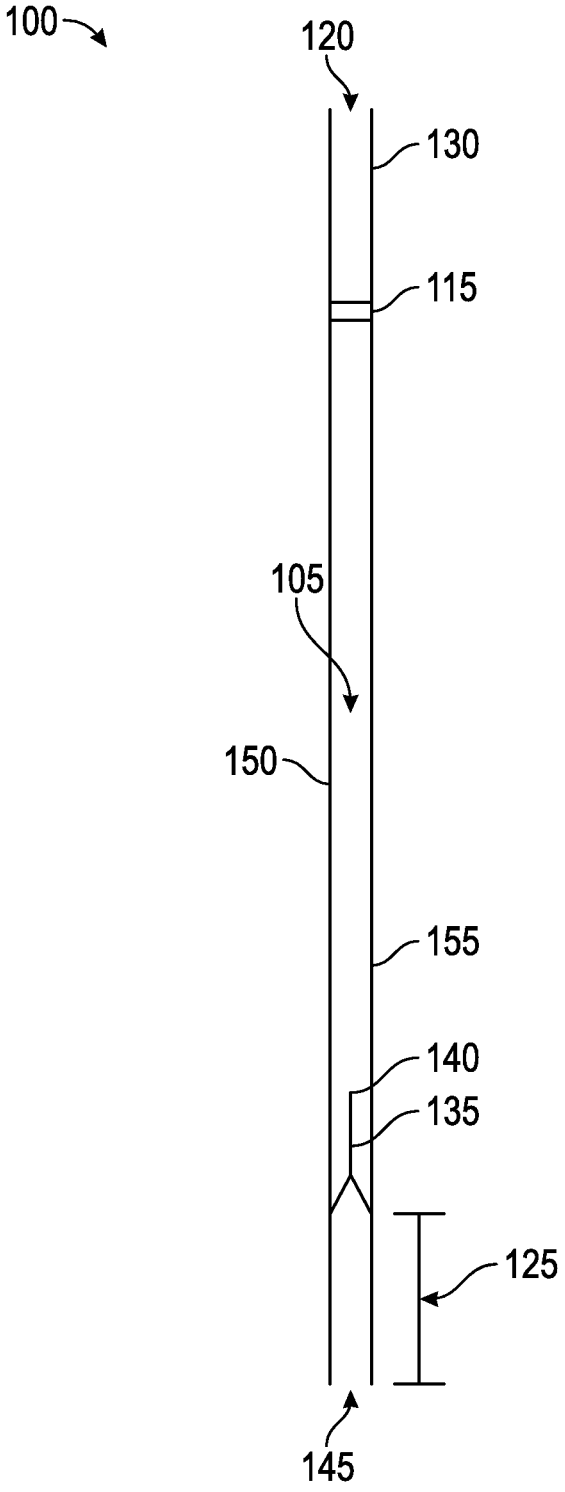
Figure 3:
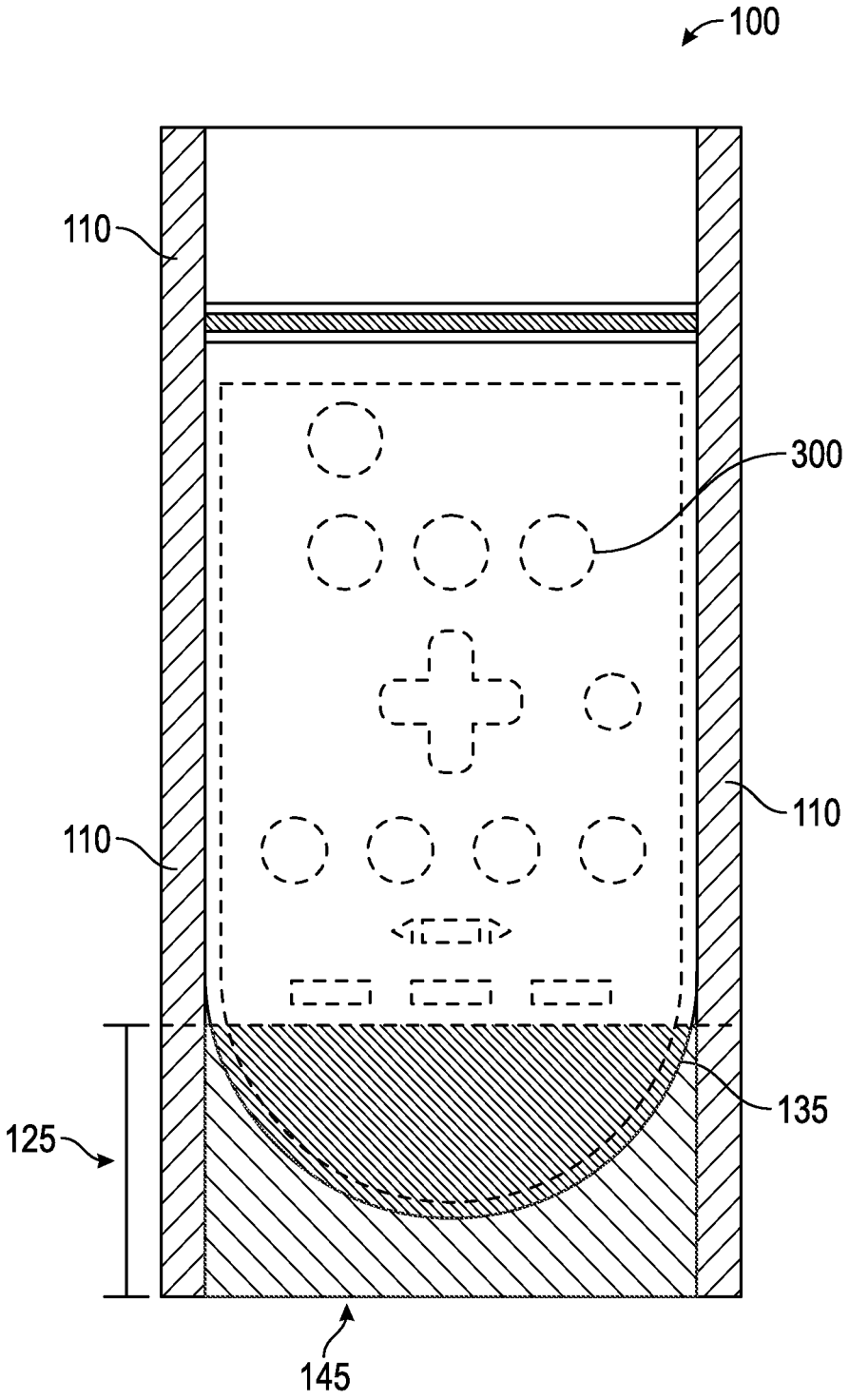
Figure 4A:
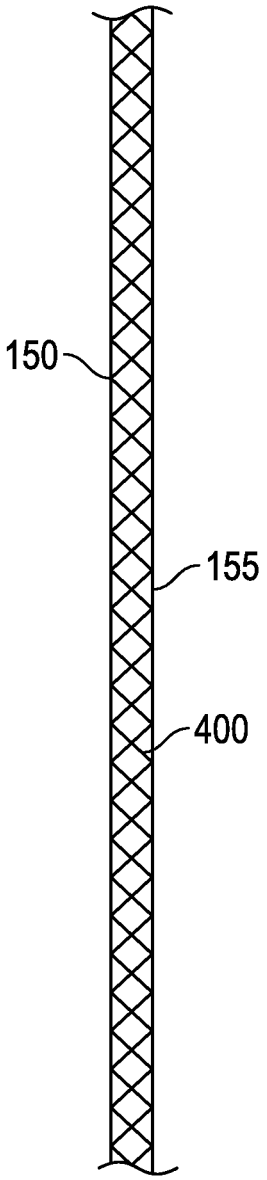
Figure 4B:
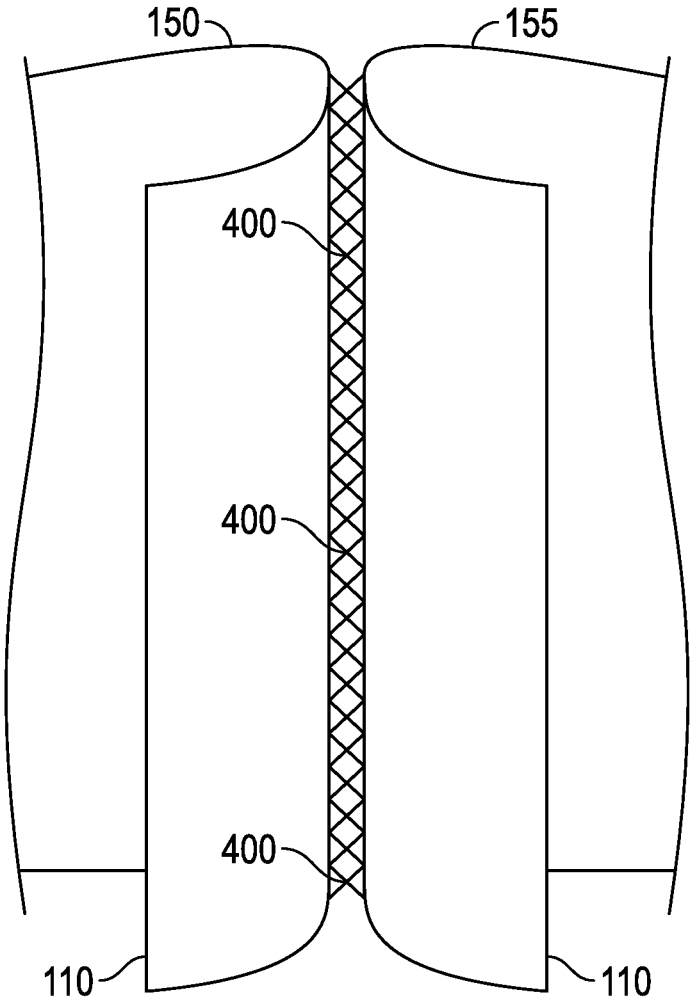
Figure 4C:
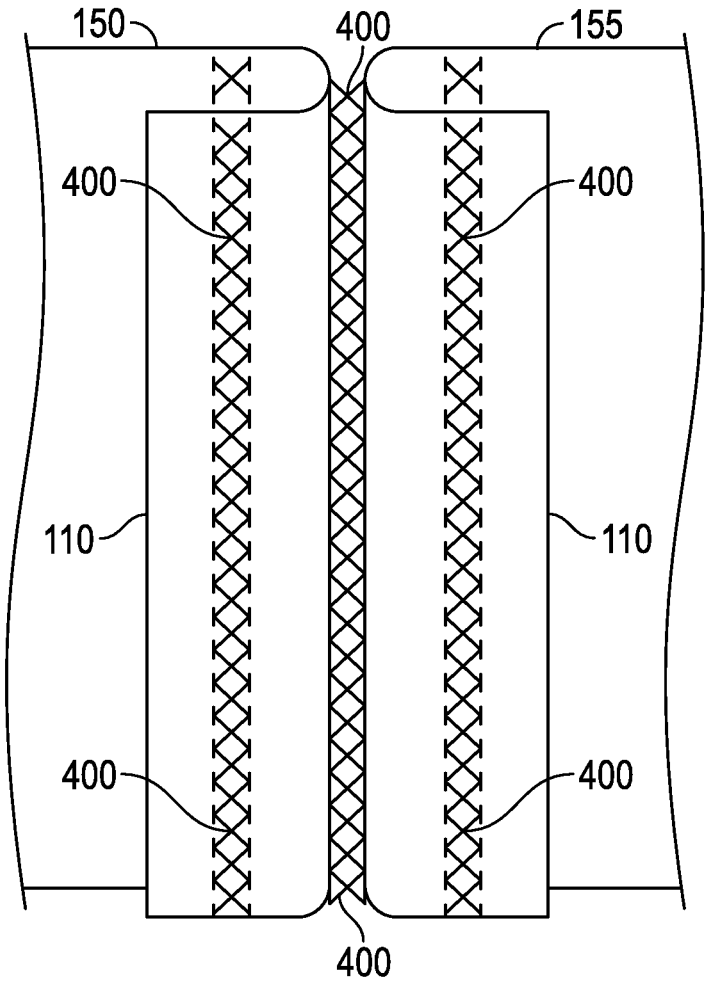
Figure 5A:
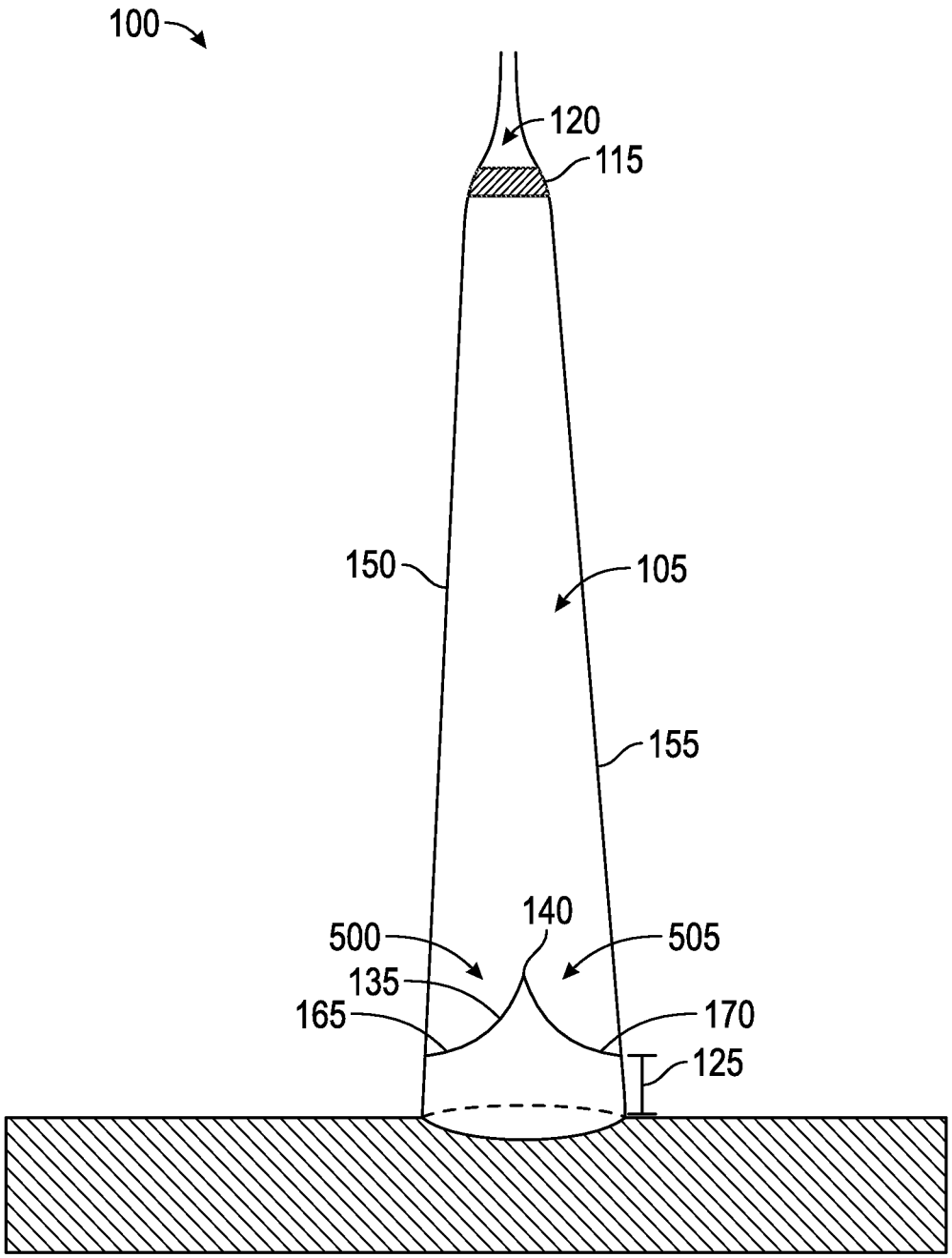
Figure 5B:
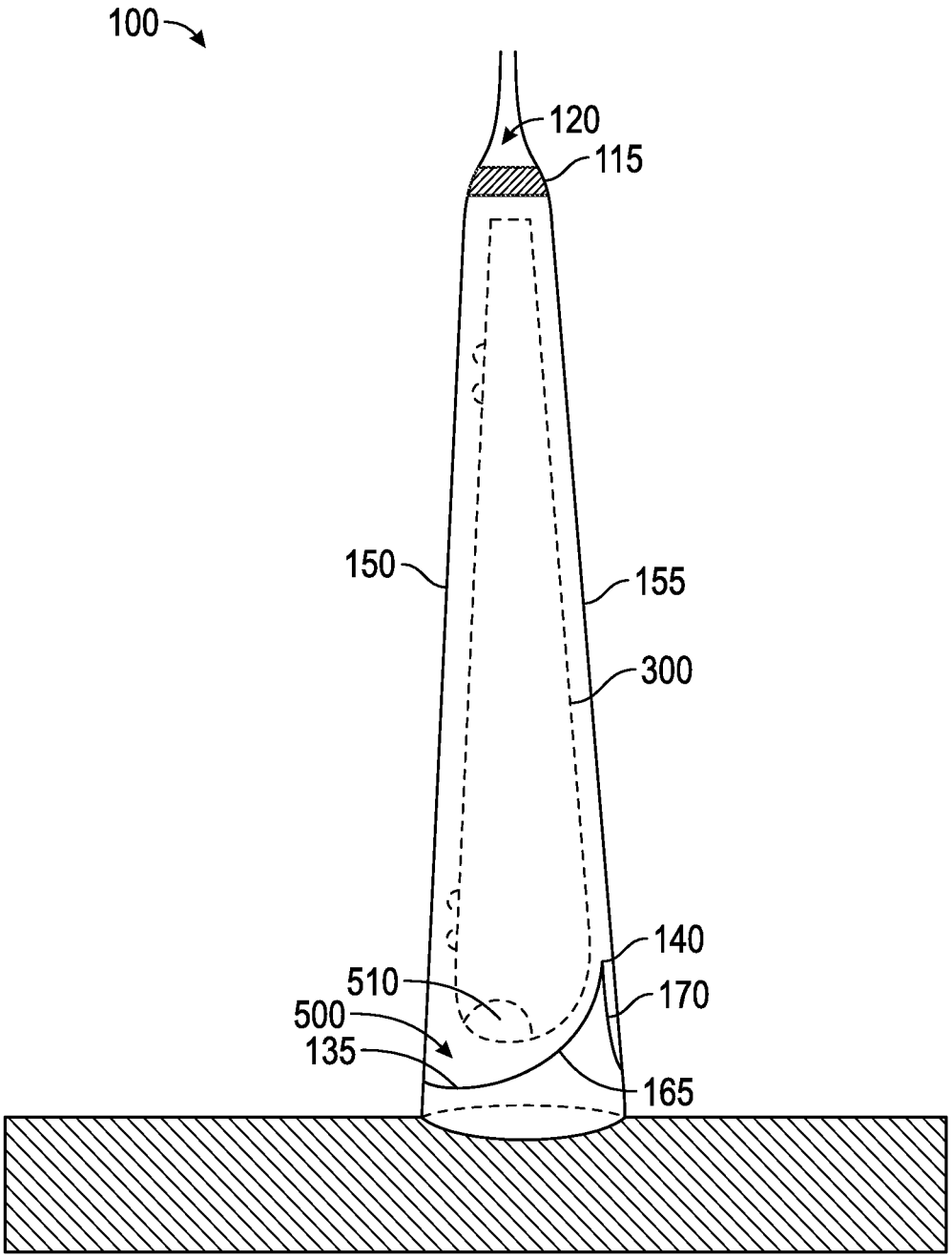
Figure 5C:
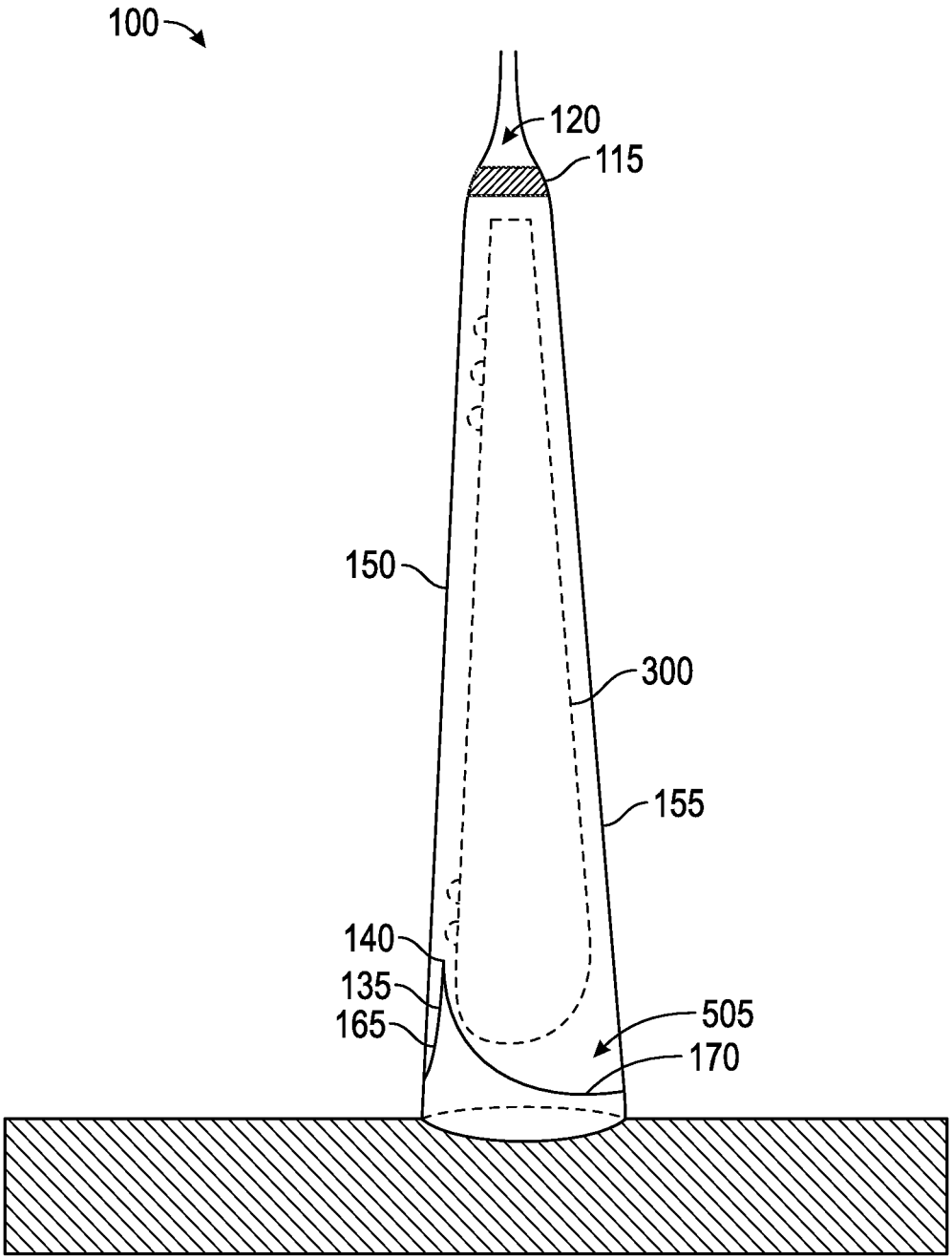

The figures described are for illustration purposes only and are not intended to limit the scope of the present disclosure in any way. Various aspects of the present technology may be more fully understood from the detailed description and the accompanying drawing figures, wherein:

FIGS. 1A-D representatively illustrate anterior and perspective views of an exemplary protective sleeve;

FIG. 2 representatively illustrates a side view of an exemplary protective sleeve;

FIG. 3 representatively illustrates an anterior view of an exemplary protective sleeve containing an electronic device;

FIGS. 4A-C representatively illustrate coupled sides edges of an exemplary protective sleeve; and FIGS. 5A-C representatively illustrate side views of an exemplary protective with an expanded sheet member.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, methods and systems according to various aspects of the present technology may employ various protective and/or sanitized materials which may be practiced in conjunction with any number of systems and methods for covering electronics, and the systems described are merely exemplary applications for the technology. Various representative implementations of the present technology may be applied to any type of electronic device such as remote control devices, gaming controllers, handheld controllers such as for massage chairs and/or hospital beds, and the like.

The particular implementations shown and described are illustrative of the technology and its best mode and are not intended to otherwise limit the scope of the present technology in any way. For the sake of brevity, conventional manufacturing, connection, preparation, sterilization, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

Various aspects of the technology provide methods, apparatus, and systems for making and using a protective sleeve for electronic devices that allows continued use of the device while placed into the protective sleeve. A detailed description of various embodiments is provided as a specific enabling disclosure that may be generalized to any application of the disclosed systems and methods.

Various representative implementations of the present technology may be applied to any appropriate system for protecting electronic devices for sanitary purposes or otherwise controlling contamination. Certain representative embodiments may include, for example, at least partially transparent materials that may be elastic, formable, fitted, or otherwise configured to loop, enclose, circumscribe, wrap around, and/or couple to the electronic device. In various embodiments, the present technology may protect the electronic device from bacteria, scratches, dust, contaminants, and the like while maintaining a functioning interface for a user of the electronic device.

Various embodiments of the present technology may provide a disposable consumable product. For example, the electronic device may be removed from an exemplary protective sleeve each time a new user will use the electronics device. The used protective sleeve may be discarded periodically, after each use, or between users. The disposable nature of the protective sleeve may reduce or prevent contamination of the electronics device and minimize transmission of harmful bacteria between users of the electronics device. For example, an exemplary protective sleeve may be applied to television remote controls in hospitals, in the hospitality industry such as in hotels, electronics stores, or any other places where users of the electronic devices frequently change. Exemplary protective sleeves may also be deployed in contaminating environments, such as wet, sandy, or dust-blown locations.

Figure 1B:
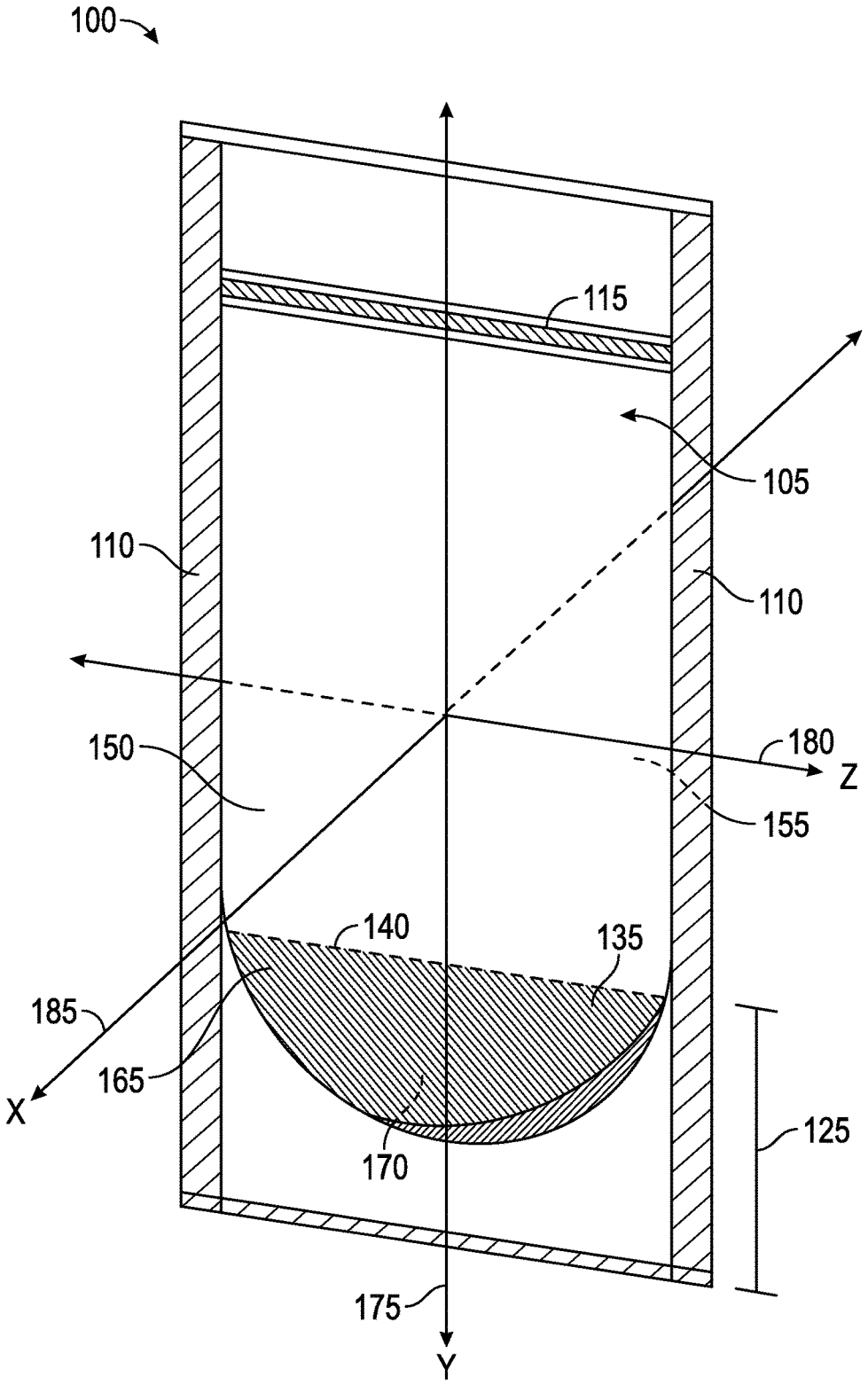

Referring to FIGS. 1A-B and 2, an exemplary protective sleeve 100 may be configured to receive an electronic device, such as a television and/or audio system remote control. In various embodiments, the protective sleeve 100 may comprise a front panel 150, a back panel 155, a top open end 120, a bottom area 125 comprising a bottom open end 145, and a fastener 115. In various embodiments, the protective sleeve 100 may further comprise an expandable sheet member 135 that may be coupled to and extending between an inner surface of the front panel 150 and the back panel 155 in the bottom area 125.

In one embodiment, the back panel 155 may be coupled to the front panel 150 along their respective side edges 110 to form an internal volume 105. The internal volume 105 may be defined by the side edges 110, the top open end 120 sealable with the fastener 115, and the bottom open end 145. The expandable sheet member 135 may be inset to the bottom open end 145, providing a seal in the bottom area 125.

Figure 1C:
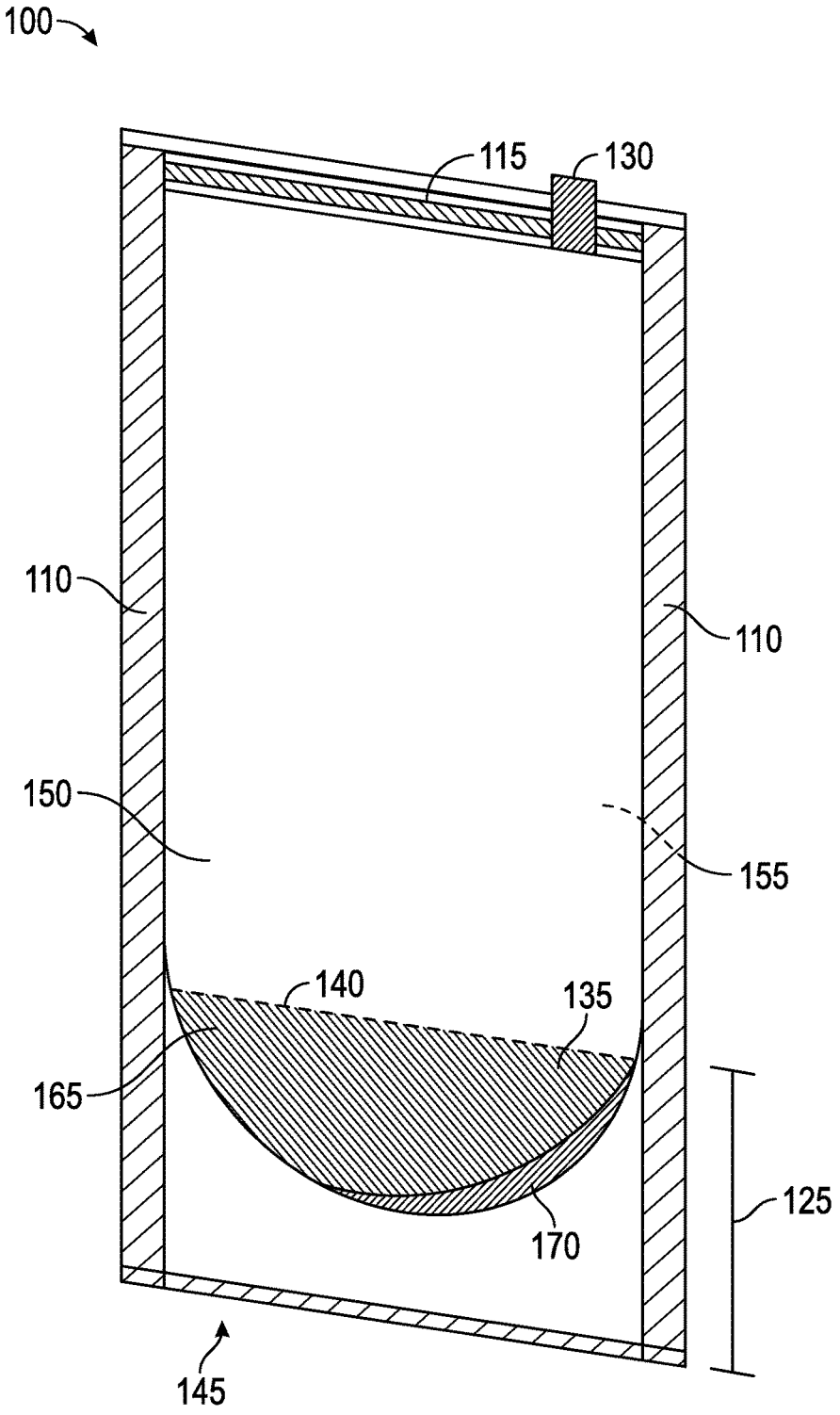

In some embodiments, the fastener 115 may be inset from the top open end 120, leaving a portion of the front panel 150 and the back panel 155 unsealed above the fastener 115, as shown in FIGS. 1A-B. The unsealed portion of the front panel 150 and the back panel 155 may allow a user to grasp each panel and pull them apart to unseal the fastener 115, such as when the fastener 115 is a tongue and groove closure. In other embodiments, the fastener 115 may be located at a top edge of the top open end 120, leaving little or no unsealed portion of the front panel 150 and the back panel 155. For example, as shown in FIG. 1C, the fastener 115 may be a tongue and groove closure with a slider 130 that opens and seals the fastener 115 as it slides back and forth.

Referring to FIGS. 4A-B, the side edges 110 may be coupled in any suitable configuration that provides a seal. For example, referring to FIG. 4A, in some embodiments, the front panel 150 and the back panel 155 may be coupled with an adhesive 400 located on inner surfaces of the side edges 110. Referring to FIG. 4B, in another embodiment, the front panel 150 and the back panel 155 may be coupled by applying the adhesive 400 to outer surfaces of the side edges 110, folding the side edges 100 inward toward the inner volume 105 and adhering the folded outer surfaces together. In some embodiments, referring to FIG. 4C, the folded outer surfaces may be pressed back onto the inner surfaces of their respective front panel 150 and back panel 155 and adhered thereon.

Various embodiments of the protective sleeve 100 may comprise any suitable circumferential shape when viewed from the front panel 150 and/or the back panel 155. As shown in FIGS. 1A-C, in some embodiments, the protective sleeve 100 may have an overall substantially rectangular shape when empty. However, any shape may be contemplated, such as rounded, variously curved, or other design elements on the top or sides (not shown). Referring to FIGS. 5B-C, in some embodiments, the overall shape of the protective sleeve 100 containing an electronic device 300 may resemble a flattened cone when viewed from the side. The top open end 120 may comprise a flat meeting point of the front panel 150 and the back panel 155. The bottom open end 145 may be expanded, forming a substantially circular, elliptical, or rectangular shape when the protective sleeve 100 contains the electronic device. In this embodiment, the dimensions of the front panel 150 and the back panel 155 may be substantially rectangular and substantially equal in their dimensions. In various embodiments, the shape of the inner volume 105 may be the same or different from the overall (circumferential) shape.

In various embodiments, the shape of the inner volume 105 may be configured to accommodate the shape of any electronic device. In some embodiments, the shape of the inner volume 105 may be dictated by the locations of the adhesive 400, the fastener 115, and/or the expandable sheet member 135. In some embodiments, the shape of the inner volume 105 may be configured to contain a variety of conventional remote controls 300. For example, an exemplary remote control 300 may be approximately 5 cm wide, 23 cm long, and 2.5 cm high. In another example, an exemplary remote control 300 may be approximately 5 cm wide, 14 cm long, and 2.5 cm high. However, it should be understood that the shape and dimensions of the protective sleeve 100 and/or the inner volume 105 may be configured to accommodate the shape of any electronic device including any remote control 300 of any size.

In various embodiments of the present technology, the top open end 120 may comprise a fastener 110 to substantially seal the top open end 120, keeping the remote control 300 securely encased inside the protective sleeve 100. In some embodiments, the fastener 110 may be configured to be opened and resealed. The fastener 110 may comprise any suitable fastener such as an integral self-sealing fastener (i.e., forming a tight seal by manually or using a sliding plastic tab to fit a thin raised strip of plastic into a corresponding groove). In other embodiments, the fastener may comprise a thread, a draw string, an adhesive, a zip tie, and the like. For example, in one embodiment, the top open end 120 may comprise a top edge that may be longer than a bottom edge such that the top edge may fold over the bottom edge and be sealed with an adhesive (not shown).

Referring to FIGS. 1B-C and 5A-C, in various embodiments of the present technology, the protective sleeve 100 may comprise the expandable sheet member 135. In some embodiments, the expandable sheet member 135 may be coupled to and extending between an inner surface of the front panel 150 and the back panel 155, forming a seal. In one embodiment, the expandable sheet member 135 may be coupled to the inner surface of the front panel 150 and the back panel 155 with an adhesive located between the front panel 150 and a portion of the expandable sheet member 135 adjacent to the first pocket 500 and between the second panel 155 and a portion of the expandable sheet member135 adjacent to the second pocket 505. In some embodiments, the adhesive may be applied to form a semicircular first pocket 500 and/or a semicircular second pocket 505.

The expandable sheet member 135 may fold inwardly towards a mid-portion of the internal volume 105 to form a ridge 140 flanked by two inwardly projecting surfaces, illustrated as a first side 165 and second side 170 as inclined planes bordering the ridge 140. Each of the two inwardly projecting surfaces may be coupled to the inner surfaces of the front panel 150 and the back panel 155 forming a first pocket 400 disposed between the front panel 150 and the first side 165 of the ridge 140 and a second pocket 405 disposed between the back panel 155 and the second side 170 of the ridge 140. Each of the first pocket 500 and the second pocket 505 may be configured to receive an end of the electronic device, such as remote control 300.

Referring to FIG. 2, in various embodiments, when empty (ie., without the electronic device) the two inwardly projecting surfaces flanking the ridge 140 may fold substantially flat along the ridge 140, resulting in the width of the protective sleeve 100 being essentially the width of the front panel 150 and the back panel 155. The flat configuration of the empty protective sleeve 100 may maximize its economical packaging and shipping.

In various embodiments, the second pocket 505 may be pushed closed upon receiving the electronic device, such as the remote control 300, into the first pocket 500 and the first pocket 500 may be pushed closed upon receiving the electronic device into the second pocket 505. As shown in FIG. 5A, the ridge 140 may be positioned toward a mid-region of the internal volume 105 when empty and the expandable sheet member 135 is expanded or stretched manually. FIG. 5B illustrates the electronic device 300 containing a transmitter 510 placed into the first pocket 500. Upon placing the electronic device 300 into the first pocket 500, the second pocket 505 (shown in FIG. 5A) may be compressed against the inner surface of the back panel 155, moving the ridge 140 from the mid-region of the inner volume 105 toward the back panel 155. Similarly, FIG. 5C illustrates the remote control 300 placed into the second pocket 505. Upon placing the electronic device 300 into the second pocket 505, the first pocket 500 (shown in FIG. 5A) may be compressed against the inner surface of the front panel 150, moving the ridge 140 from the mid-region of the inner volume 105 toward the front panel 150. In various embodiments, the first pocket 500 and/or the second pocket 505 may be configured to receive the electronic device 300.

Referring to FIG. 2 (flat confirmation) and FIGS. 5A-C (stretched confirmation), upon expansion, the degree of inward projection of the two inwardly projecting surfaces of the expandable sheet member 135 may be reduced while maintaining the degree of inward projection above horizontal. For example, in some embodiments, the ridge 140 may remain above a lowest point in a bottom the first pocket 400 and the second pocket 405 when containing the electronic device. Accordingly, in some embodiments, the expandable sheet member 135 may not be flattened (ie. horizontal) when the electronic device 300 is placed into either of the first pocket 400 and/or the second pocket 405.

Figure 1D:
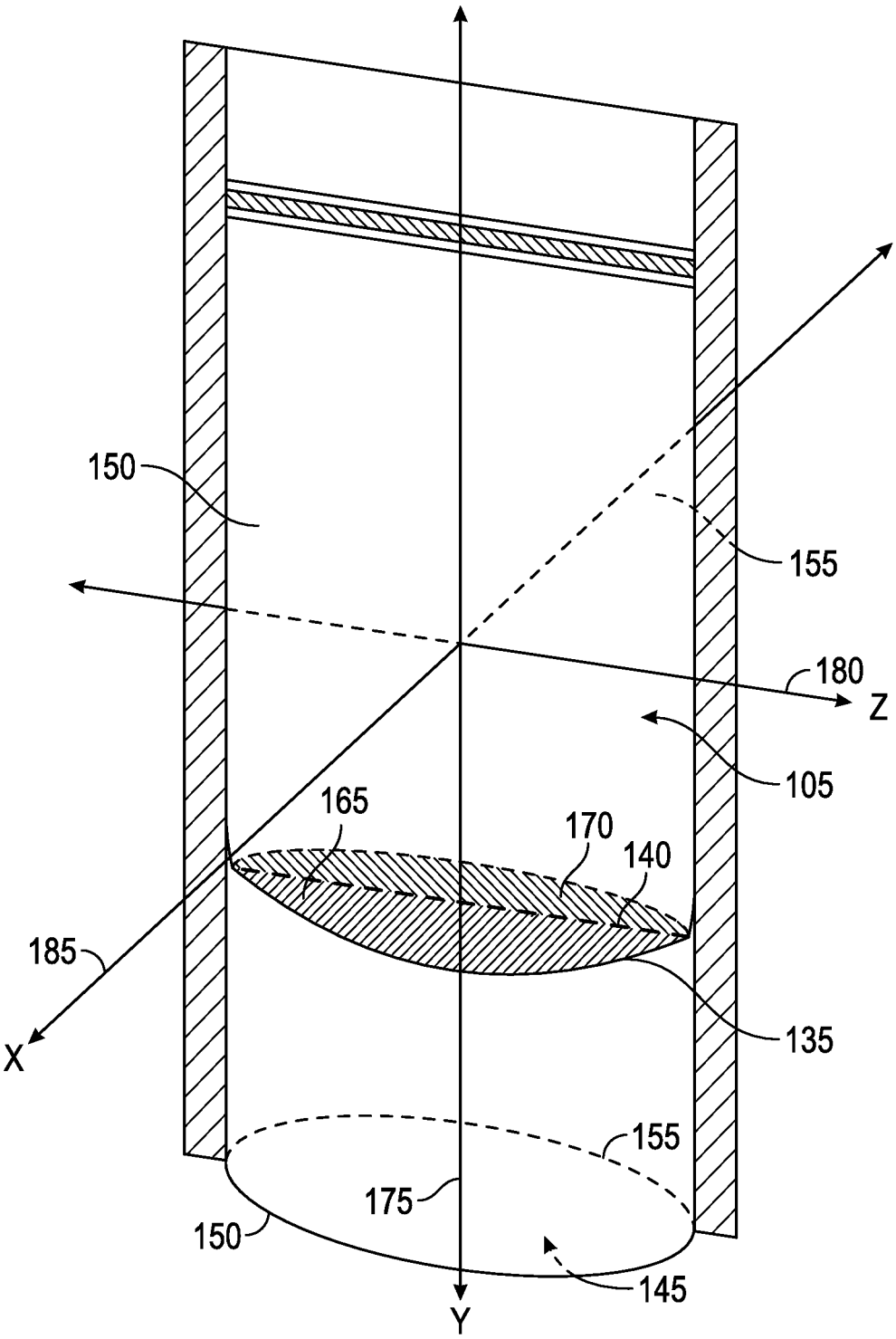

In various embodiments, referring to FIGS. 1B and D, expansion of the expandable sheet member 135 may widen the internal volume 105 along one horizontal axis while contracting the internal volume 105 along a second horizontal axis. For example, FIG. 1B depicts the empty protective sleeve 100 with three-dimensional axis: a vertical y axis 175, a horizontal z axis 180 corresponding to the width of the protective sleeve 100, and a horizontal x axis 185 perpendicular to the x axis and corresponding to a depth. FIG. 1D then depicts the same three-dimensional axis on the protective sleeve 100 with the expanded expandable sheet member 135 (remote control not shown). The width of the protective sleeve 100 along the z axis 180 may contract, moving toward the mid-region of the internal volume 105, while the depth along its x axis 185 may widen to accommodate the size of the remote control 300. The vertical y axis 175 may remain substantially unchanged upon placing the remote control 300 into the protective sleeve 100.

Referring to FIG. 1D, in some embodiments, the contraction of the width of the protective sleeve 100 and the expansion of its depth may separate the front panel 150 from the back panel 155, forming an oval or ellipse shape along the bottom open end 145. This shape, in combination with the firmness of the material used to make the front panel 150 and the back panel 155, as described below, may allow the protective sleeve 100 to stand on its bottom open end 145 when it contains the electronic device. In some embodiments, the expandable sheet member 135 should be inset a suitable distance from the bottom open end 145 that may be sufficient to retain the electronic device above the bottom open end 145. The inset distance may prevent interference of the electronic device with the ability of the protective sleeve 100 to stand on the bottom open end 145. For example, the protective sleeve 100 may tip over from a standing position if the end of the electronic device is equal with or extends beyond the bottom open end 145.

In various embodiments, the expandable sheet member 135 may comprise a material that may be transmissive to any type of transmitter in the electronic device 300, such as infrared (IR) diodes, radio signals, and the like. The material may comprise an optically transmissive material for use with conventional IR based remote controls to allow the transmitter to communicate with a remote device. In another embodiment, the expandable sheet member 135 may comprise perforations to allow transmission of the IR signal.

In some embodiments of the present technology, the entire protective sleeve 100 may comprise a single continuous piece of material. In some embodiments, the expandable sheet member 135 may be a folded portion of the single continuous piece of material. In other embodiments, the expandable sheet member 135 may comprise a second piece of material coupled to and extending between an inner surface of the front panel 150 and the back panel 155 in the bottom area 125. Accordingly, the inner volume 105 may be enclosed upon engagement of the fastener 115. In some embodiments, the protective sleeve 100 may circumscribe and fully contain the remote control 300. In other embodiments, the protective sleeve 100 may circumscribe and at least partially contain the remote control 300.

In various embodiments, the protective sleeve 100 may comprise any suitable material that allows continued use the remote control 300 disposed inside the protective sleeve 100. In some embodiments, the protective sleeve 100 may comprise a material that is sufficiently thin-walled such that human fingertips can feel the buttons 305 on the remote control 300. In some embodiments, the front panel 150 and/or the expandable sheet member 135 may be optically transmissive to allow the surface of the remote control 300 to be visible and/or to allow the remote control 300 to communicate with a remote device, such as a television, with conventional wireless signals such as infrared light signals. In other embodiments, the entire protective sleeve 100 may comprise optically transmissive materials.

In various embodiments of the present technology, the protective sleeve 100 may comprise one or more materials that may be sufficiently flexible to allow its deformation as the expandable sheet member 135 expands and sufficiently firm to allow standing of the protective sleeve 100 on its bottom open end145. For example, the protective sleeve 100 may comprise materials such as at least one of a plastic, silicone, biodegradable materials, polyethylene, latex, polyurethane, polyisoprene, and a thin polymeric material. In some embodiments, the material may be a single layer or multi-layered. In some embodiments, the material may be sufficiently thin to provide tactile sensation of the buttons 305 to a user of the remote control 300. In some embodiments, the material may be thick enough to resist ripping, such as from fingers or fingernails.

In the foregoing description, the technology has been described with reference to specific exemplary embodiments. Various modifications and changes may be made, however, without departing from the scope of the present technology as set forth. The description and figures are to be regarded in an illustrative manner, rather than a restrictive one and all such modifications are intended to be included within the scope of the present technology. Accordingly, the scope of the technology should be determined by the generic embodiments described and their legal equivalents rather than by merely the specific examples described above. For example, the steps recited in any method or process embodiment may be executed in any appropriate order and are not limited to the explicit order presented in the specific examples. Additionally, the components and/or elements recited in any system embodiment may be combined in a variety of permutations to produce substantially the same result as the present technology and are accordingly not limited to the specific configuration recited in the specific examples.

Benefits, other advantages and solutions to problems have been described above with regard to particular embodiments. Any benefit, advantage, solution to problems or any element that may cause any particular benefit, advantage or solution to occur or to become more pronounced, however, is not to be construed as a critical, required or essential feature or component.

The terms "comprises", "comprising", or any variation thereof, are intended to reference a non-exclusive inclusion, such that a process, method, article, composition, system, or apparatus that comprises a list of elements does not include only those elements recited, but may also include other elements not expressly listed or inherent to such process, method, article, composition, system, or apparatus. Other combinations and/or modifications of the above-described structures, arrangements, applications, proportions, elements, materials or components used in the practice of the present technology, in addition to those not specifically recited, may be varied or otherwise particularly adapted to specific environments, manufacturing specifications, design parameters or other operating requirements without departing from the general principles of the same.

The present technology has been described above with reference to an exemplary embodiment. However, changes and modifications may be made to the exemplary embodiment without departing from the scope of the present technology. These and other changes or modifications are intended to be included within the scope of the present technology.

What is claimed is:

1. A protective sleeve for containing an electronic device comprising:

a front panel;

a back panel coupled to the front panel along their respective side edges to form an internal volume comprising a top open end and a bottom open end;

an optically transmissive expandable sheet member coupled to and extending between an inner surface of the front panel and the back panel and inset from the bottom open end of the internal volume, wherein:

the expandable sheet member folds inwardly towards a mid-portion of the internal volume to form a ridge flanked by two inwardly projecting surfaces;

an edge of each of the two inwardly projecting surfaces are coupled to the inner surface of the front panel and back panel, forming:

a first pocket disposed between the front panel and a first side of the ridge; and a second pocket disposed between the back panel and a second side of the ridge;

expansion of the expandable sheet member:

reduces a degree of inward projection of the two inwardly projecting surfaces while maintaining the degree of inward projection above horizontal; and widens the internal volume along one horizontal axis while contracting the internal volume along a second horizontal axis; and a fastener coupled to the front panel and the back panel configured to form a seal along the top open end to secure the electronic device within the internal volume.

2. The protective sleeve of claim 1, wherein the fastener is configured to be opened and resealed.

3. The protective sleeve of claim 1, wherein the fastener is located on the inner surfaces of the front panel and the back panel and inset from the top open end.

4. The protective sleeve of claim 1, wherein the fastener comprises a tongue and groove closure.

5. The protective sleeve of claim 1, wherein the dimensions of the inner volume substantially conform to a length and width of the electronic device.

6. The protective sleeve of claim 1, wherein the expandable sheet member is inset a distance from the bottom open end sufficient to retain the electronic device above the bottom open end to prevent interference of the electronic device with standing the protective sleeve on its bottom open end.

7. The protective sleeve of claim 5, wherein the front panel and the back panel comprise a material that is sufficiently flexible to allow its deformation as the expandable sheet member expands and sufficiently firm to allow standing of the protective sleeve on the bottom open end.

8. The protective sleeve of claim 1, wherein both the first pocket and the second pocket are configured to receive an end of the electronic device.

9. The protective sleeve of claim 6, wherein the second pocket is pushed closed upon receiving the electronic device into the first pocket and the first pocket is pushed closed upon receiving the electronic device into the second pocket.

10. The protective sleeve of claim 1, wherein first panel is coupled to the second panel with adhesive located on an inner surface of the respective side edges.

11. The protective sleeve of claim 1, wherein the expandable sheet member is coupled to the inner surface of the front panel and the back panel with an adhesive located between the front panel and a portion of the expandable sheet member adjacent to the first pocket and between the second panel and a portion of the expandable sheet member adjacent to the second pocket.

12. The protective sleeve of claim 10, wherein the adhesive is applied to form a semicircular first pocket and a semicircular second pocket.

13. The protective sleeve of claim 1, wherein the inner volume is substantially impermeable to moisture and air when the fastener is sealed.

14. The protective sleeve of claim 1, wherein at least one of the front panel and the back panel are optically transmissive.

15. The protective sleeve of claim 1, wherein the two inwardly projecting surfaces are inclined planes.

16. The protective sleeve of claim 1, wherein the expandable sheet member folds along the ridge to allow the protective sleeve to lay substantially flat when it does not contain the electronic device.

17. The protective sleeve of claim 1, wherein an outside surface of the front panel and the back panel are coated with an antimicrobial composition.

18. A protective sleeve for containing an electronic device comprising:

a front panel;

a back panel coupled to the front panel along their respective side edges to form an internal volume comprising a top open end and a bottom open end;

an optically transmissive expandable sheet member coupled to and extending between an inner surface of the front panel and the back panel and inset from the bottom open end of the internal volume sufficient to retain the electronic device above the bottom open end, wherein:

the expandable sheet member folds inwardly towards a mid-portion of the internal volume to form a ridge flanked by two inwardly projecting surfaces;

an edge of each of the two inwardly projecting surfaces are coupled to the inner surface of the front panel and back panel, forming:

a first pocket disposed between the front panel and a first side of the ridge; and a second pocket disposed between the back panel and a second side of the ridge;

expansion of the expandable sheet member:

reduces a degree of inward projection of the two inwardly projecting surfaces while maintaining the degree of inward projection above horizontal; and widens the internal volume along one horizontal axis while contracting the internal volume along a second horizontal axis; and a fastener coupled to the front panel and the back panel configured to form a seal along the top open end to secure the electronic device within the internal volume;

wherein the front panel and the back panel comprise a material that is sufficiently flexible to allow its deformation as the expandable sheet member expands and sufficiently firm to allow standing of the protective sleeve on its bottom open end.

19. The protective sleeve of claim 18, wherein both the first pocket and the second pocket are configured to receive an end of the electronic device.

20. The protective sleeve of claim 18, wherein the expandable sheet member is coupled to the inner surface of the front panel and the back panel with an adhesive located between the front panel and a portion of the expandable sheet member adjacent to the first pocket and between the second panel and a portion of the expandable sheet member adjacent to the second pocket.

21. The protective sleeve of claim 20, wherein the adhesive is applied to form a semicircular first pocket and a semicircular second pocket.

22. The protective sleeve of claim 18, wherein the inner volume is substantially impermeable to moisture and air when the fastener is sealed.

23. The protective sleeve of claim 18, wherein the fastener is located on the inner surfaces of the front panel and the back panel and inset from the top open end.

24. A method of protecting an electronic device comprising:

making a protective sleeve comprising:

a front panel;

a back panel coupled to the front panel along their respective side edges to form an internal volume comprising a top open end and a bottom open end;

an optically transmissive expandable sheet member coupled to and extending between an inner surface of the front panel and the back panel and inset from the bottom open end of the internal volume, wherein:

the expandable sheet member folds inwardly towards a mid-portion of the internal volume to form a ridge flanked by two inwardly projecting surfaces;

an edge of each of the two inwardly projecting surfaces are coupled to the inner surface of the front panel and back panel, forming:

a first pocket disposed between the front panel and a first side of the ridge; and a second pocket disposed between the back panel and a second side of the ridge;

expansion of the expandable sheet member:

reduces a degree of inward projection of the two inwardly projecting surfaces while maintaining the degree of inward projection above horizontal; and widens the internal volume along one horizontal axis while contracting the internal volume along a second horizontal axis; and a fastener located on the inner surfaces of the front panel and the back panel inset from the top open end and configured to form a seal to secure the electronic device within the internal volume; and inserting the electronic device into the protective sleeve and sealing the fastener.

* * * * *